US005403092A

United States Patent [19]

Lichtenberg et al.

[11] Patent Number: 5,403,092

[45] Date of Patent: Apr. 4, 1995

[54] VISCOUS SHEAR MIXING DEVICE AND METHOD

[75] Inventors: Glen S. Lichtenberg; John R. Tinney, both of Rochester; Paul A. Corbelli, LeRoy; Gerald T. Frizelle, Marion, all of N.Y.

[73] Assignee: Eastman Kodak Company, Rochester, N.Y.

[21] Appl. No.: 189,628

[22] Filed: Feb. 1, 1994

[51] Int. Cl.[6] ..... B01F 7/00

[52] U.S. Cl. ..... 366/279; 366/195; 366/166.1

[58] Field of Search ..... 366/279, 262, 263, 264, 366/265, 342, 343, 244, 245, 247, 249, 250, 251, 194, 195, 166

[56] References Cited

U.S. PATENT DOCUMENTS

| | | | |
|---|---|---|---|
| 10,245 | 11/1853 | Grover et al. . | |
| 1,406,791 | 2/1922 | Werner . | |
| 2,125,455 | 8/1938 | McLean | 259/9 |
| 2,254,127 | 8/1941 | Underwood | 366/265 |
| 2,436,585 | 2/1948 | Mangold | 99/252 |
| 2,607,566 | 8/1952 | Saunders | 257/108 |
| 2,995,346 | 8/1961 | Samples | 259/3 |
| 3,043,570 | 7/1962 | Seiter | 366/263 |
| 3,514,079 | 5/1970 | Little, Jr. et al. | 259/9 |
| 3,684,732 | 8/1972 | Grabauskas | 252/311 |
| 3,986,706 | 10/1976 | Giombini | 259/24 |
| 4,007,920 | 2/1977 | Plunguian et al. | 259/108 |
| 4,030,707 | 6/1977 | Moreton | 259/8 |
| 4,091,463 | 5/1978 | Tschudy et al. | 366/298 |
| 4,112,517 | 9/1978 | Giombini | 366/102 |
| 4,175,873 | 11/1979 | Iwako et al. | 366/165 |
| 4,201,486 | 5/1980 | Huebner et al. | 366/196 |
| 4,313,909 | 2/1982 | Boden et al. | 422/133 |
| 4,486,102 | 12/1984 | Thiele et al. | 366/182 |
| 4,750,843 | 6/1988 | Endtner et al. | 366/177 |
| 4,834,545 | 5/1989 | Inoue et al. | 366/138 |
| 4,952,065 | 8/1990 | Kreuziger | 366/139 |
| 5,085,810 | 2/1992 | Burrows | 261/140.1 |
| 5,160,461 | 11/1992 | Burrows | 261/140.1 |
| 5,211,916 | 5/1993 | Cheng | 422/107 |

*Primary Examiner*—Robert W. Jenkins
*Attorney, Agent, or Firm*—Carl F. Ruoff

[57] ABSTRACT

An apparatus and method for mixing photographic emulsions is disclosed. The mixer is a truncated hollow cone having a first circumference and a second end having a second circumference. The second circumference is larger than the first circumference. The cone is attached to an end of a central shaft attached to the first end. The rotation of the shaft produces micromixing of the photographic emulsion while minimizing air entrainment.

5 Claims, 2 Drawing Sheets

VISCOUS SHEAR MIXING DEVICE AND METHOD

FIELD OF THE INVENTION

The present invention relates to a method and apparatus for the agitation of photographic emulsions. More particularly, the present invention produces photographic products that have improved properties.

BACKGROUND OF THE INVENTION

During the manufacture of light sensitive film and paper, three distinct steps are carried out: 1) preparation of the light sensitive emulsion; 2) manufacture of the base or support for the emulsion; and 3) coating of the emulsion on the base. Typically, the emulsion contains silver halide and is prepared by precipitation, washing, and spectral and chemical sensitizations. The emulsion can include addenda such as anti-fogging agents, stabilizers, coating additives and coupler dispersions, all of which are usually added to the emulsion prior to coating. During the process of preparing the emulsion prior to coating, the emulsion is frequently stored in an open vessel. While being stored in an open vessel, it is necessary to continuously agitate the emulsion to prevent the gelatin from forming slugs. It is also necessary to agitate the emulsion to prevent settling of the silver halide particles in the emulsion.

Prior art mixing devices include marine propellers which splash and induce significant entrained air. In addition, while draining a kettle being agitated by a marine propeller, it is necessary to stop the agitation or the air entrainment of the emulsion becomes unacceptable. Finally, propellers do not induce short length scale mixing in the region of microns (micromixing) of the emulsion, rather, they act as a pump, providing long length scale mixing in the region of millimeters (macromixing) without micromixing.

The present invention is a method and apparatus that allows one to agitate an emulsion in an open vessel while inhibiting air entrainment to provide a homogeneous solution to the coating device.

SUMMARY OF THE INVENTION

The present invention is a mixing device for gelatin solutions in a kettle which includes, a shaft extending into the kettle terminating at an end and a truncated hollow cone having a first circumference at a first end and a second circumference at a second end, the second circumference larger than the first circumference, the hollow cone attached to the end of the shaft at the first end, wherein said shaft is rotated such that micromixing of the gelatin solution occurs while entrainment of air is minimized.

The present invention also includes the method of using the mixing device.

For a better understanding of the present invention, together with other advantages and capabilities thereof, reference is made to the following detailed description and appended claims in connection with the preceding drawings.

DETAILED DESCRIPTION OF THE PREFERRED EMBODIMENTS

Figure 1:
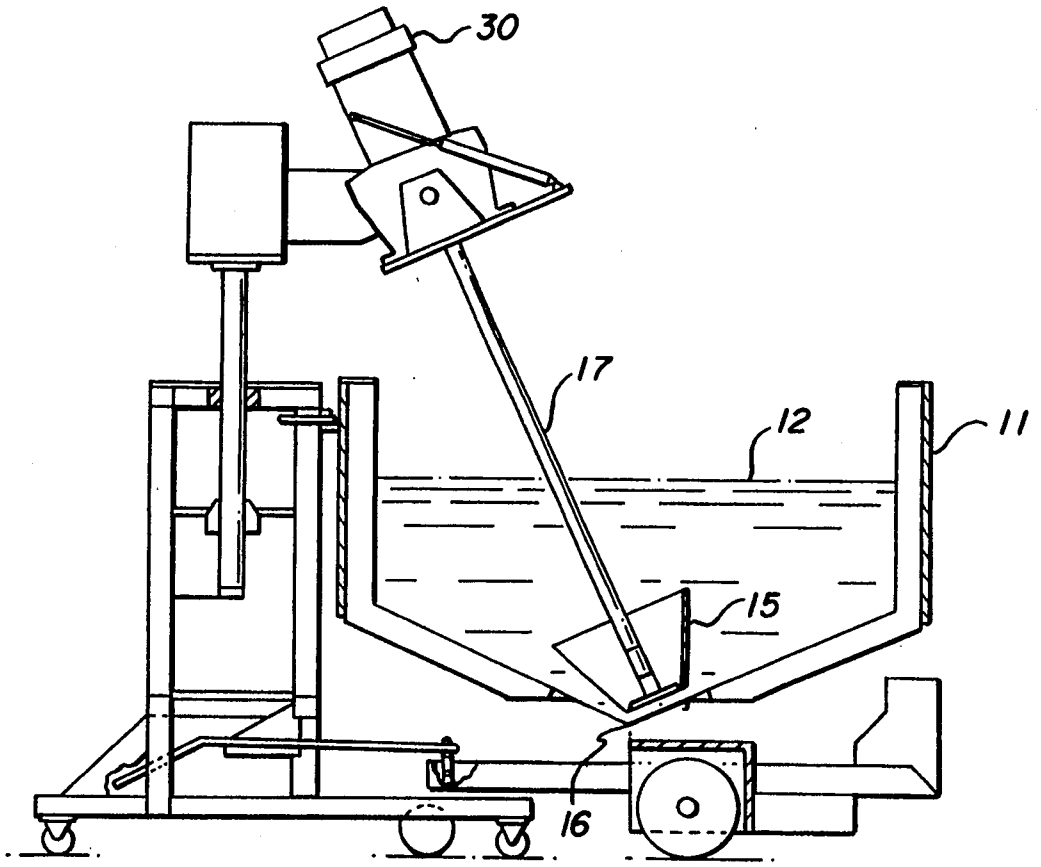
FIG. 1 shows a sectional view of the kettle and the placement of the mixer of the present invention.

FIG. 1 shows a sectional view of a vessel or kettle 11 containing photographic emulsion shown generally as 12. The mixer 15 of the present invention is placed into the vessel 11. FIG. 1 shows the general orientation of the cone mixer 15 in the vessel 11. Note that mixing is achieved to the bottom of vessel 11, just above the drain hole 16. The approximate size of the cone relative to the vessel is also shown in FIG. 1. Truncation of the cone allows for stiffer support through the struts. The mixer 15 is attached to a drive motor 30 through shaft 17.

Figure 2:
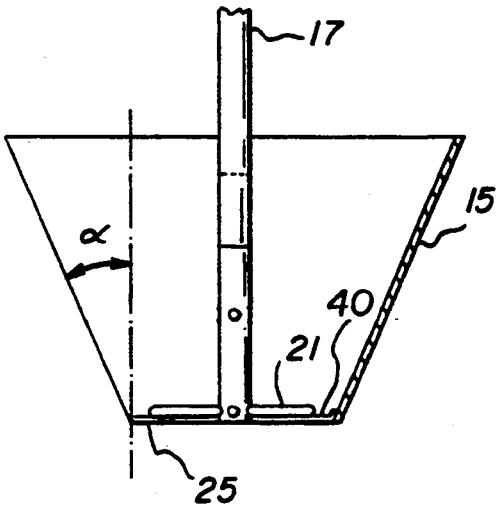
FIG. 2 shows a side view of the cone mixer of the present invention.
Figure 3:
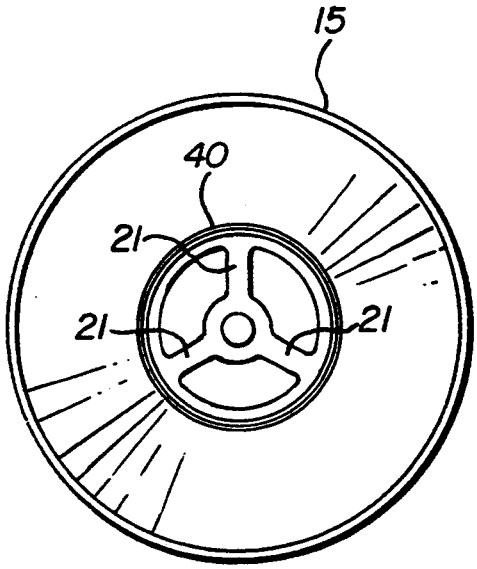
FIG. 3 shows a top view of the cone mixer of the present invention.

FIG. 2 shows a side-sectional view of the mixer 15 of the present invention. The cone mixer 15 is truncated at one end 25 and the surface of the cone forms an angle $\alpha$ with the shaft. It is preferable that the shaft form an angle $\alpha$ with respect to the vertical when the mixer is placed in the kettle, as this minimizes air entrainment. In this orientation, as shown in FIG. 1, the surface of the cone is parallel to the vertical walls of the kettle. It appears that this increases the shear rate. If the shaft is vertical (parallel to the vertical kettle walls) the cone mixer of the present invention produces premature vortexing or swirling within the kettle. The angle $\alpha$ is preferably from greater than 0° to about 45°. The preferred orientation and angle $\alpha$ of the cone mixer inhibits air entrainment. In the preferred embodiment of the present invention one set of struts 21 is used to hold the mixer to the cone shaft 17. FIG. 3 shows a top view of the cone mixer 15 looking down from the wide end of the mixer.

Figure 4:
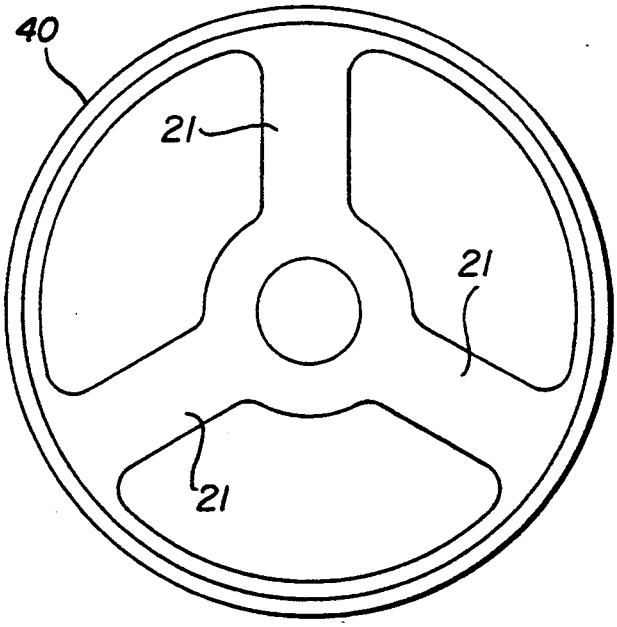
FIG. 4 shows a top view of the mounting bracket used to attach the cone mixer of the present invention to a shaft.
Figure 5:
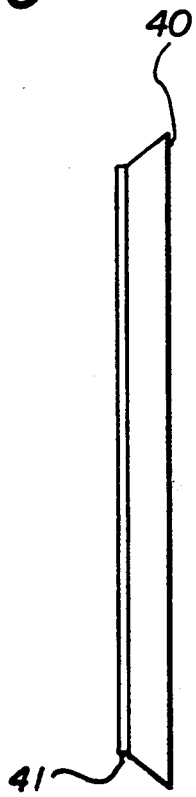
FIG. 5 shows a side view of the bracket of FIG. 4.

FIGS. 4 and 5 show the strut assembly 40 used to attach the cone mixer 15 to the shaft 17. It is important that the cone mixer 15 be centered with respect to the shaft. Any wobble, due to the cone mixer being off-center, and the mixer loses its effectiveness. The strut assembly was made from stainless steel and has a thickness of approximately one-half inch. The strut assembly 40 is machined to match the angle $\alpha$ of the cone. Additionally, the strut assembly 40 is machined to have the outer diameter of the dimple 41 match the inner diameter of the small circumference end of the cone. The strut assembly 40 is inserted into the cone mixer and pressed into the small circumference end 25 of the cone mixer 15. After press fitting the strut, the strut and mixer are welded together. The mixer/strut assembly is then attached to the shaft. This provides an assembly mechanism which ensures the cone is centered on the shaft. Although the strut assembly 40 is shown with three struts, any number of struts are possible on the assembly. The strut and cone mixer are stainless steel although other materials, including plastics, will work.

Several key process steps in the manufacture of photographic products are largely affected by mixing during the supply of the photographic emulsion. Some of these process steps include filtration, debubbling-/degassing, temperature control and particle suspension. Each of these areas require continual agitation. It has been found that the cone mixer of the present invention is advantageous over prior art mixers.

Film coatings are extremely sensitive to unwanted debris in the liquid product supply, thus, filtration is required. The nature of what needs to be filtered varies from airborne fibers to gel slugs. The latter of which can form in the supply position just prior to coating. Some of these gel slugs are soft and can extrude through the filter. It is these types of slugs that can be reduced by the short length scale mixing of the cone mixer of the present invention. Cleaner coatings have been realized where this mode of agitation has been applied.

EXAMPLE

Tests were run to compare the performance of cone mixers with traditional propeller mixers. Identical ten percent gelatin solutions were made and placed in kettles having a forty pound storage capacity. The temperature of the kettles was maintained at 104° F. The gelatin solutions had shown no difference in the amount of gel slugs after the gelatin solution was liquefied and had reached a temperature of 104° F. In one kettle a traditional propeller was used at speeds of from 400–800 rpm. The traditional propeller was an A310 three inch diameter, three blade propeller available from Lightnin Mixing & Aerators located in Rochester, N.Y. In the other kettle a cone mixer having a six inch upper diameter and three inch lower diameter having a $4\frac{3}{4}$ inch central axis was rotated at speeds ranging from 400–800 rpm. After forty-five minutes the number of gel slugs increased in the batches agitated by the propeller. The number of gel slugs remained constant in the batches mixed with the cone mixer.

Bubbles in the product flow can produce spot, line and streak imperfections in the coating. Inherent in the coating process are various types of debubbling equipment. If axial flow mixers are left on as supply kettles are drained, significant air entrainment occurs. It is advantageous in most, and critical in others, not to entrain air during the debubbling step. However, the need to agitate the product still exists. The cone, by nature of its symmetry, significantly reduces air entrainment. The struts at the small end of the cone do not achieve high tangential velocity to cause significant air entrainment. Even when this minimal period of air entrainment takes places it is at the extreme low point of the kettle. An axial flow device has to be turned off with three to four times of the product remaining in the kettle to that of the cone. The large diameter surface speed is one of the controlling factors in air entrainment.

Photographic emulsions contain silver halide particles on the order of 0.2 to 3 microns in size. Product uniformity is directly related to how well these particles are uniformly distributed throughout the kettle. Initial testing has shown a positive impact in the prevention of silver settling. Application in production has shown this to be true on certain products. Silver laid down on the web routinely varied out of specification. Melt drift was the assigned cause, and this was thought to be chemical in nature. Application of the cone mixer showed conclusively that the drift was mechanical settling and was time related to the duration of a melt. Particle suspension is achieved even when the surface velocity of the cone is about five feet per second.

While there has been shown and described what are presently considered preferred embodiments of the invention, it will be obvious to those skilled in the art the various changes and modifications that may be made therein without departing from the scope of the invention as defined by the appended claims.

What is claimed is:

1. A mixing device for gelatin solutions in a kettle consisting of:

a shaft extending into the kettle terminating at an end; and a truncated hollow cone having a first circumference at a first end and a second circumference at a second end, the second circumference larger than the first circumference, the hollow cone attached symmetrically to the end of the shaft at the first end, wherein said shaft is rotated such that micromixing of the gelatin solution occurs while entrainment of air is minimized.

2. The mixing device according to claim 1 wherein the cone includes a smooth surface extending from the first circumference to the second circumference, the surface forming an angle $\alpha$ with respect to the shaft, the angle $\alpha$ being greater than 0° to about 45°.

3. The mixing device according to claim 2 wherein the shaft extends into the kettle at the angle $\alpha$ with respect to the vertical.

4. A method of mixing a gelatin solution comprising:

providing a truncated hollow cone having a central axis having a first circumference at a first end and a second circumference at a second end, the second circumference larger than the first circumference;

positioning the hollow cone in the gelatin solution with the first end lower than the second end; and rotating the cone along the central axis wherein the gelatin is micromixed thereby preventing formation of gelatin slugs.

5. The method according to claim 4 further comprising:

removing the gelatin solution while the hollow cone continues rotating.

* * * * *